US008973213B2

(12) United States Patent
Kim

(10) Patent No.: US 8,973,213 B2
(45) Date of Patent: Mar. 10, 2015

(54) DUST COLLECTION UNIT AND VACUUM CLEANER WITH THE SAME

(71) Applicant: Dongbu Daewoo Electronics Corporation, Seoul (KR)

(72) Inventor: Yong Ho Kim, Incheon (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 13/959,466

(22) Filed: Aug. 5, 2013

(65) Prior Publication Data

US 2014/0041148 A1 Feb. 13, 2014

(30) Foreign Application Priority Data

Aug. 6, 2012 (KR) ..... 10-2012-0085830

(51) Int. Cl.
*A47L 9/18* (2006.01)
*A47L 9/16* (2006.01)

(52) U.S. Cl.
CPC ..... *A47L 9/187* (2013.01); *A47L 9/1683* (2013.01); *A47L 9/181* (2013.01); *A47L 9/183* (2013.01)
USPC ..... 15/347; 15/353

(58) Field of Classification Search
USPC ..... 15/347, 352, 353, 327.1; 261/72.1, 120; 96/361; 55/223, 244, 247, 249, 256, 55/406, 418, 426, DIG. 3
See application file for complete search history.

(56) References Cited

U.S. PATENT DOCUMENTS

| | | | | |
|---|---|---|---|---|
| 2,405,494 | A * | 8/1946 | Dupuy | 96/340 |
| 3,778,978 | A * | 12/1973 | Matsushita | 96/274 |
| 4,874,404 | A * | 10/1989 | Boswell | 95/151 |
| 5,908,493 | A * | 6/1999 | Krymsky | 96/333 |
| 6,866,705 | B2 * | 3/2005 | Nielsen et al. | 96/276 |
| 7,246,406 | B2 * | 7/2007 | Yarbrough et al. | 15/353 |
| 8,695,159 | B2 * | 4/2014 | Van Der Kooi et al. | 15/353 |

* cited by examiner

*Primary Examiner* — Dung Van Nguyen

(57) ABSTRACT

Disclosed herein are a dust collection unit and a vacuum cleaner with the same. The dust collection unit includes: a container formed in an empty cylindrical shape and filled with water to a predetermined height above a lower wall, the container having an inlet and an outlet formed in an upper wall; and a water flow pipe whose top is joined to the inlet and whose bottom is submerged in water in such a manner that the bottom of the water flow pipe is spaced apart from the lower wall. The water flow pipe includes: a first pipe, a second pipe having a second inner diameter smaller than the first inner diameter and extending downwardly from the bottom of the first pipe; and a water channel formed in a body of the second pipe defining the second inner diameter in such a way as to fluidably communicate with the inside of the second pipe.

12 Claims, 5 Drawing Sheets

DUST COLLECTION UNIT AND VACUUM CLEANER WITH THE SAME

BACKGROUND OF THE INVENTION

1. Field of the Invention

The present invention relates to a dust collection unit and a vacuum cleaner with the same, and more particularly, to a dust collection unit for collecting dust using a water filter and a vacuum cleaner with the same.

2. Background Art

In general, most of cleaners adopt a method of inhaling refuges, such as dust, together with air using a suction power by a motor and/or a fan and filtering and collecting the refuges by a filter, such as a dust bag, or a method of collecting dust of a relatively large particle size in a dust container using the cyclone principle and filtering and removing dust of a small particle size using a dense filter.

Such cleaners have several problems in that they are very inconvenient in disposing a large quantity of the collected dust, in that they are unsanitary due to a great deal of harmful substances contained in the air discharged to the outside because the cleaner is used repeatedly in a state where the collected dust is accumulated in the cleaner for a long time, and in that the filter requires a periodic replacement and it needs costs to purchase filters.

Recently, in order to overcome the above-mentioned problems, a cleaner using a water filter has been invented. However, because the conventional vacuum cleaner using the water filter adopts a method of jetting and collecting air and dust in water using a water flow pipe, a part of the water flow pipe is exposed out of the water by jetting speed and pressure of the air and the dust through the water flow pipe, and hence, the dust is discharged out without being adsorbed to the water.

SUMMARY OF THE INVENTION

Accordingly, the present invention has been made to solve the above-mentioned problems occurring in the prior arts, and it is an object of the present invention to provide a dust collection unit, which can enhance dust collection efficiency, and a vacuum cleaner with the same.

To achieve the above objects, the present invention provides a dust collection unit including: a container formed in an empty cylindrical shape and filled with water to a predetermined height above a lower wall, the container having an inlet and an outlet formed in an upper wall; and a water flow pipe whose top is joined to the inlet and whose bottom is submerged in water in such a manner that the bottom of the water flow pipe is spaced apart from the lower wall, wherein the water flow pipe includes: a first pipe having a first inner diameter and being joined to the inlet; a second pipe having a second inner diameter smaller than the first inner diameter and extending downwardly from the bottom of the first pipe; and a water channel formed in a body of the second pipe defining the second inner diameter in such a way as to fluidably communicate with the inside of the second pipe, wherein the second pipe and the water channel are located under the surface of the water, and the dust contained in the air introduced into the second pipe through the first pipe is collected by the water supplied through the water channel.

A plurality of the water channels are inclined downwardly toward the center of the second inner diameter and provided along the circumference of the second pipe.

The water flow pipe extends downwardly from the bottom of the second pipe and further comprises a third pipe whose inner diameter becomes gradually larger than the second inner diameter in the downward direction.

The dust collection unit further includes a filter arranged between the surface of the water and the lower wall, the bottom of the water flow pipe being inserted into the filter.

The dust collection unit further includes a water cyclone member arranged between the surface of the water and the filter for rotating the water containing dust and air in the circumferential direction.

The water cyclone member includes: a vertical wall formed in a ring shape and arranged under the surface of the water in such a way as to be in contact with the inner wall of the container; a plurality of discharge parts protruding in the direction of the height of the vertical wall and respectively having discharge holes formed at one side thereof in the circumferential direction, the discharge parts being joined to the inner face of the vertical wall along the circumferential direction; and an inclined wall extending toward the center of the vertical wall from the discharge parts in such a way as to be inclined downwardly, the second pipe being inserted into the inclined wall, wherein the inlet of the water channel faces a space formed between the inclined wall and the surface of the water.

In another aspect of the present invention, the present invention provides a vacuum cleaner includes: a suction part for inhaling dust and air; a fan-motor unit providing a suction power to the suction part; and the dust collection unit according to one of claims 1 to 6, the dust collection unit being arranged in an air flow path between the suction part and the fan-motor unit for collecting the dust.

As described above, the dust collection unit and the vacuum cleaner having the dust collection unit according to the present invention can enhance the dust collection efficiency using the water flow pipe to which Bernoulli's principle is applied.

BRIEF DESCRIPTION OF THE DRAWINGS

For the purposes of illustrating the preferred embodiment of the disclosure, reference is made to the drawings, but it should be understood that the present invention is not limited to the illustrated embodiment and drawings, in which.

DETAILED DESCRIPTION OF THE PREFERRED EMBODIMENT

Figure 1:
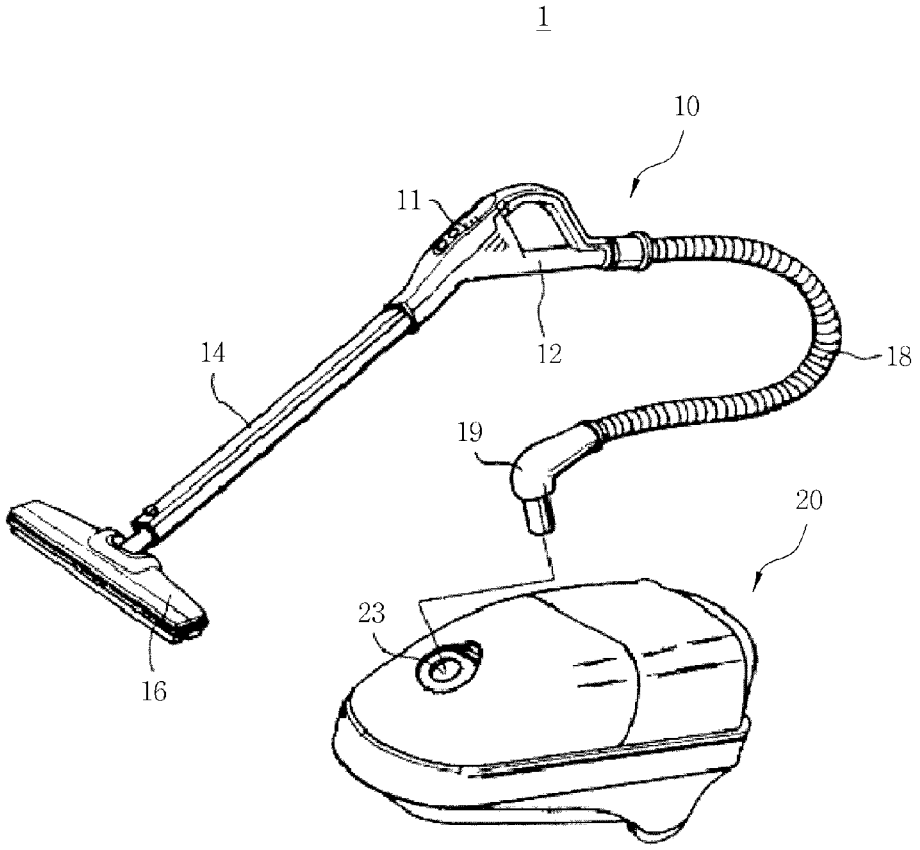
FIG. 1 is a perspective view of a vacuum cleaner according to a preferred embodiment of the present invention.

Reference will be now made in detail to a dust collection unit and a vacuum cleaner with the same according to the preferred embodiment of the present invention with reference to the attached drawings. First, in the drawings, the same components have the same reference numerals even though they are illustrated in different figures. In addition, in the description of the present invention, when it is judged that detailed descriptions of known functions or structures related with the present invention may make the essential points vague, the detailed descriptions of the known functions or structures will be omitted.

Embodiment

FIG. 1 is a perspective view of a vacuum cleaner according to a preferred embodiment of the present invention.

Referring to FIG. 1, the vacuum cleaner 1 according to a preferred embodiment of the present invention includes a suction part 10 and a cleaner main body 20. The cleaner main body 20 provides a suction power to the suction part 10, and the suction part 10 inhales dust and air. The dust and air inhaled through the suction part 10 are introduced into the cleaner main body 20, and the cleaner main body 20 collects dust using water, and then, discharges the air, from which dust is removed, to the outside.

The suction part 10 includes a hand-grip part 12, a suction tube 14, a suction nozzle 16, a suction hose 18, and a connection tube 19. The hand-grip part 12 has a controlling part 11 for controlling the operation of the vacuum cleaner 1. The suction tube 14 is detachably joined to the front end of the hand-grip part 12, and the suction nozzle 16 is joined to the front end of the suction tube 14. The suction nozzle 16 inhales dust and air. The suction hose 18 is joined to the rear end of the hand-grip part 12, and the suction hose 18 is joined to a suction hole 23 of the cleaner main body 20 through the connection tube 19. The suction hose 18 and the connection tube 19 induce the dust and air inhaled by the suction nozzle 16 into the cleaner main body 20.

Figure 2:
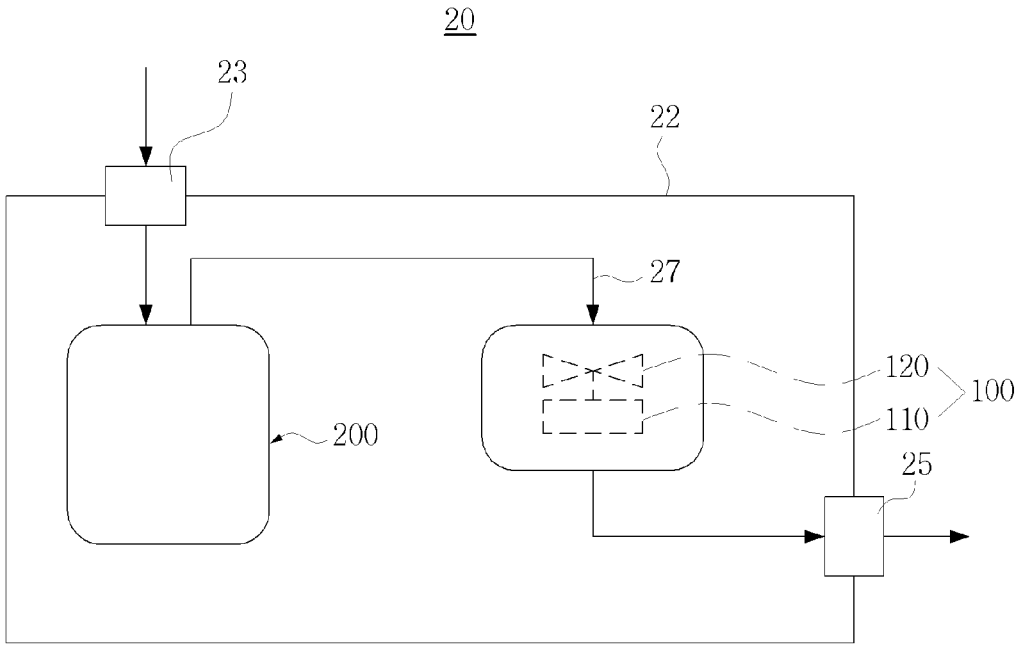
FIG. 2 is a block diagram showing a structure of a cleaner main body of FIG. 1.

FIG. 2 is a block diagram showing a structure of a cleaner main body 20 of FIG. 1.

Referring to FIG. 2, the cleaner main body 20 includes a housing 22, a fan-motor unit 100, and a dust collection unit 200. The housing 22 has the suction hole 23 and an exhaust hole 25, and an air flow path 27 provided inside the housing 22 in order to connect the suction hole 23 and the exhaust hole 25 with each other. The fan-motor unit 100 and the dust collection unit 200 are arranged in the air flow path 27. The fan-motor unit 100 is arranged at the rear end of the dust collection unit 200, and provides the suction power for inhaling dust and air to the suction part 10 after passing through the dust collection unit 200. The fan-motor unit 100 includes a motor 110 and a suction fan 120 rotated by the motor 110.

The connection tube 19 of the suction part 10 is joined to the suction hole 23, and hence, the dust and air inhaled by the suction nozzle 16 of the suction part 10 are flowed into the suction hole 23 through the connection tube 19. The dust and air inhaled into the suction hole 23 are transferred to the dust collection unit 200 through the air flow path 27, and the dust collection unit 200 collects dust in the air. The air from which dust is removed passes through the air flow path 27 by the suction power and the air blast power of the fan-motor unit 100 and is transferred to the exhaust hole 25. The exhaust hole 25 discharges the air from which dust is removed, namely, the purified air, to the outside from the housing 22.

Figure 3:
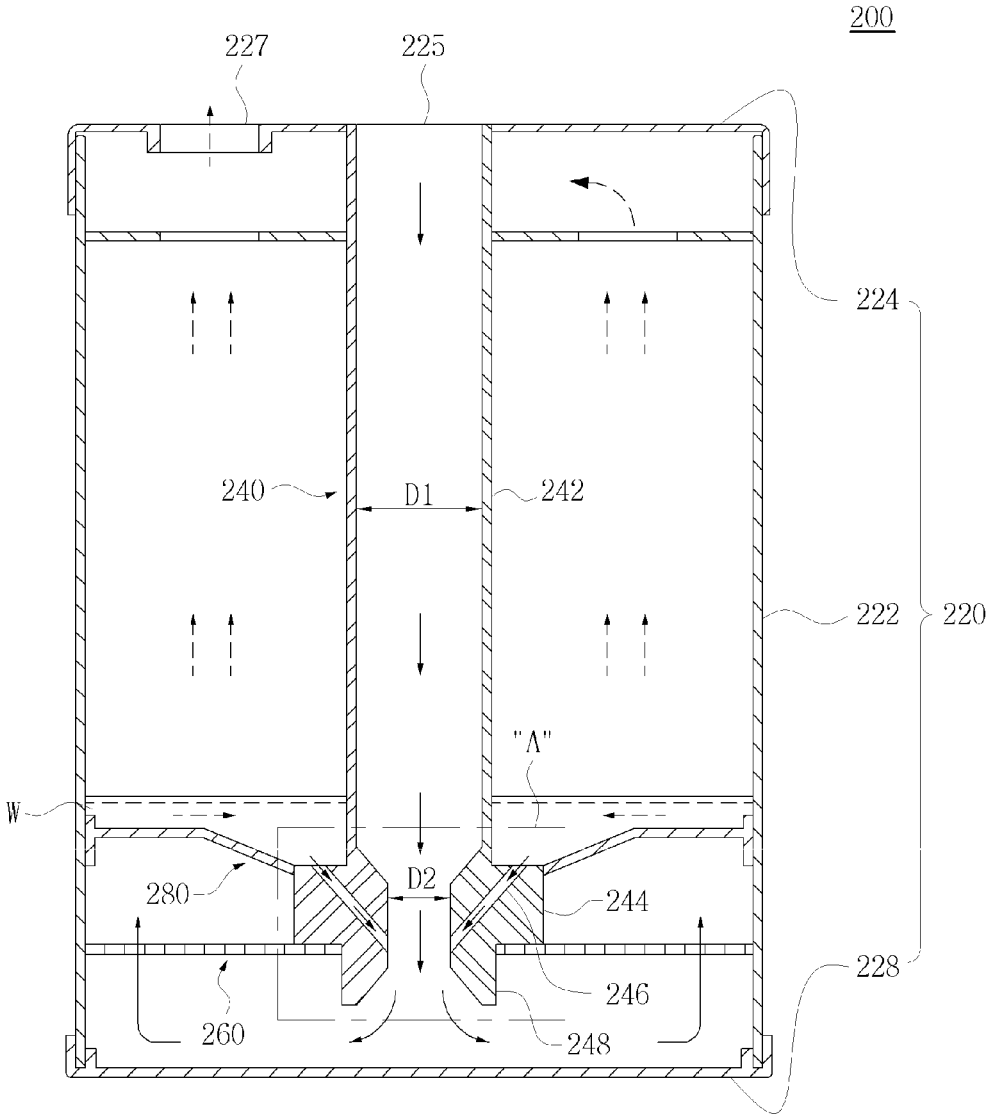
FIG. 3 is a sectional view of a dust collection unit.
Figure 4:
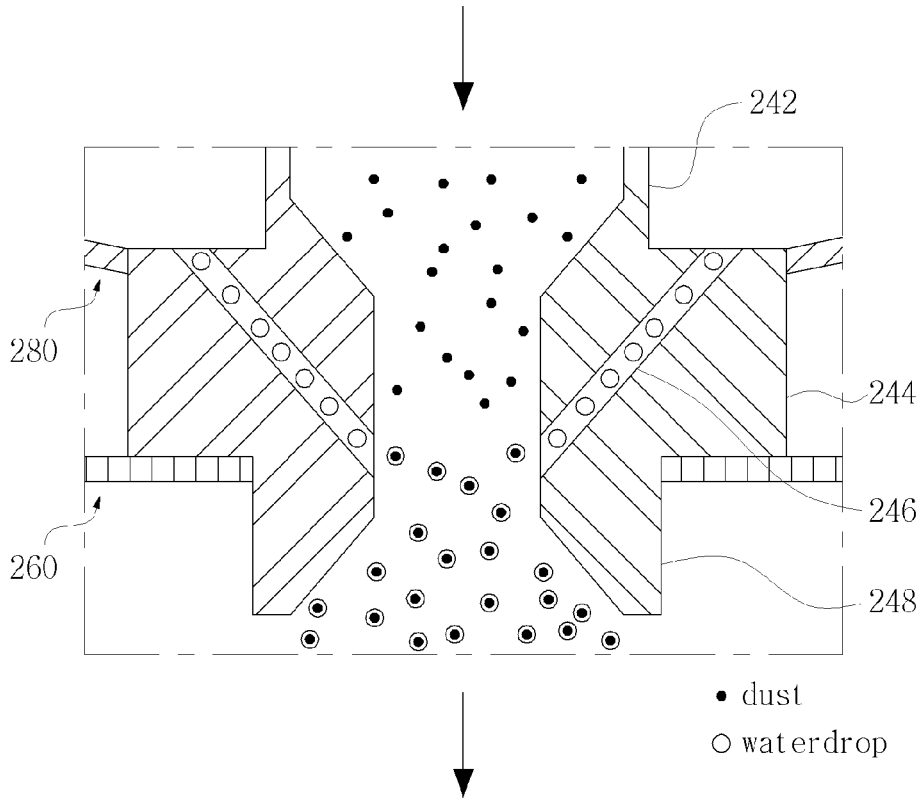
FIG. 4 is an enlarged view of an "A" part of FIG. 3.
Figure 5:
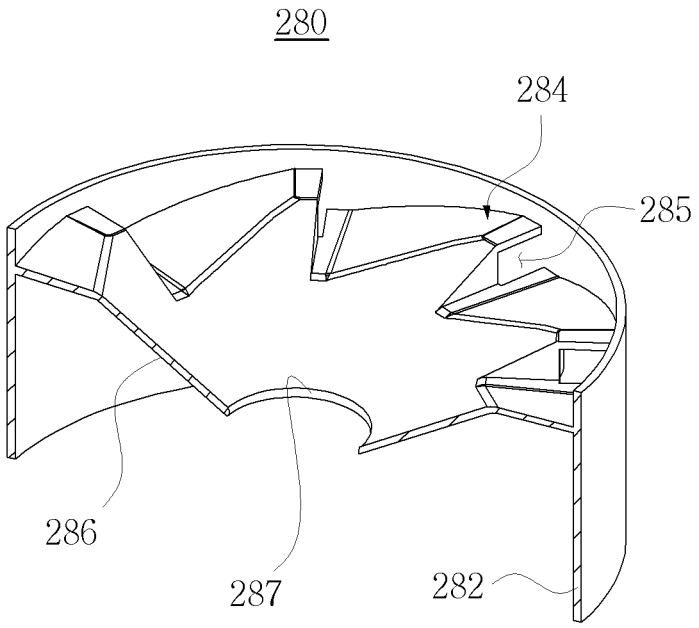
FIG. 5 is a perspective view, partly in section, of a water cyclone member of FIG. 3.

FIG. 3 is a sectional view of a dust collection unit, FIG. 4 is an enlarged view of an "A" part of FIG. 3, and FIG. 5 is a perspective view, partly in section, of a water cyclone member of FIG. 3. Referring to FIGS. 3 to 5, the dust collection unit 200 includes a container 220, a water flow pipe 240, a filter 260, and a water cyclone member 250.

The container 220 includes: a cylindrical body 222 opened at the top and the bottom; an upper cap 224 joined to the opened top of the body 222; and a lower cap 228 joined to the opened bottom of the body 222. The upper cap 224 has an inlet 225 and an outlet 227. The inlet 225 fluidably communicates with the suction part 10 through the suction hole 23 of the cleaner main body, and the outlet 227 fluidably communicates with the fan-motor unit 100. A space defined by the body 222 and the lower cap 228 is filled with water (W), which performs a filtering function, to a predetermined height. Here, the upper cap 224 and the lower cap 228 may be referred to an upper wall and a lower wall.

The top of the water flow pipe 240 is joined to the inlet 225, and the bottom of the water flow pipe 240 is submerged in water in such a way as to be spaced apart from the lower cap 228. In detail, the water flow pipe 240 includes a first pipe 242, a second pipe 244, water channels 246, and a third pipe 248.

The first pipe 242 has a first inner diameter (D1) and extends long in the downward direction, and the top of the first pipe 242 is inserted and joined into the inlet 225. The second pipe 244 has a second inner diameter (D2) smaller than the first inner diameter (D1), and extends in the downward direction from the bottom of the first pipe 242 in such a way as to be submerged in water (W). Connection parts of the first pipe 242 and the second pipe 244 may be tapered.

The water channels 246 are formed in a body of the second pipe 244 defining the second inner diameter (D2) so as to fluidably communicate with the inside of the second pipe 244. A plurality of the water channel 246 are inclined in the downward direction toward the center of the second inner diameter (D2), and provided along the circumferential direction of the second pipe 244. The top of the water channel 246 is opened upwardly, and the bottom of the water channel 246 is opened toward the inside of the second pipe 244. The water introduced into the top of the water channel 246 is discharged to the inside of the second pipe 244 through the bottom of the water channel 246.

The dust and air introduced into the first pipe 242 through the inlet 225 form a descending current and flow into the second pipe 244. At this instance, because the second inner diameter (D2) of the second pipe 244 is smaller than the first inner diameter (D1) of the first pipe 242, the velocity of the dust and air inside the second pipe 244 becomes faster than the velocity of the dust and air inside the first pipe 242, and finally, the inside pressure of the second pipe 244 becomes lower than the inside pressure of the first pipe 242 (Bernoulli's principle). In the above state, water is introduced into the second pipe 242, which is in the lower pressure state, through the water channel 244, and hence, dust in the air is collected by the water introduced into the second pipe 242.

The third pipe 248 extends in the downward direction from the bottom of the second pipe 244, and the inner diameter becomes larger than the second inner diameter (D2) toward the bottom. Because the inner diameter of the third pipe 248 becomes gradually larger than the second inner diameter (D2), the velocity of the fluid becomes gradually slower, and hence, the water collecting dust and the air containing dust are diffused. Moreover, a bubble phenomenon occurs by air (containing dust) introduced into the water (W) and the water collecting dust through the third pipe 248, and hence, a contact area among dust, air and water is expanded, and during the above process, dust in the air is separated in the water (W) and is adsorbed to the water (W).

The filter 260 is arranged between the surface of water and the lower cap 228. In detail, the filter 260 surrounds the third pipe 248 so as to filter dust of a large particle size in the air which passes the third pipe 248 of the water flow pipe 240. Thereby, it can prevent that the dust of the large particle size is introduced to the top of the water channel 246 and the water channel 246 is stopped.

The water cyclone member 280 is arranged between the surface of water and the filter 260, and then, water containing the dust and air passing through the filter 260 is rotated in the circumferential direction of the container 220. The water cyclone member 280 includes a vertical wall 282, discharge parts 284, and an inclined wall 286. The vertical wall 282 is formed in a ring shape, and is arranged under the surface of the water (W) in such a way as to be in contact with the inner face of the body 222 of the container 220. As shown in FIG. 5, a plurality of the discharge parts 284 protrude in the direction of the height of the vertical wall 282, and is joined to the inner face of the vertical wall 282 along the circumference of the vertical wall 282. Each of the discharge parts 284 facing the circumferential direction of the vertical wall 282 has a discharge hole 285 formed at one side thereof. The inclined wall 286 extends downward toward the center of the vertical wall 282 from the discharge parts 284. The inclined wall 286 has a connection hole 287 formed in the middle thereof in order to communicate the upper part and the lower part of the inclined wall 286 with each other, and the second pipe 244 of the water flow pipe 240 is inserted into the connection hole 287.

The water containing dust and air passing through the filter 260 is rotated in the circumferential direction of the vessel 220 while being discharged through the discharge parts 284 of the water cyclone member 280, and hence, the air is separated from the water during the above process. The separated air is discharged out through the outlet 227 formed in the upper cap 224 of the container 220. Furthermore, the rotated water moves toward the top of the water channel 246 along the inclined wall 286 of the water cyclone member 280, and then, is introduced into the top of the water channel 246.

As described above, while the present invention has been particularly shown and described with reference to the example embodiments thereof, it will be understood by those of ordinary skill in the art that the above embodiments of the present invention are all exemplified and various changes, modifications and equivalents may be made therein without changing the essential characteristics and scope of the present invention. Therefore, it would be understood that the embodiments disclosed in the present invention are not to limit the technical idea of the present invention but to describe the present invention, and the technical and protective scope of the present invention shall be defined by the illustrated embodiments. It should be also understood that the protective scope of the present invention is interpreted by the following claims and all technical ideas within the equivalent scope belong to the technical scope of the present invention.

What is claimed is:

1. A dust collection unit comprising:

a container formed in an empty cylindrical shape and filled with water to a predetermined height above a lower wall, the container having an inlet and an outlet formed in an upper wall; and a water flow pipe whose top is joined to the inlet and whose bottom is submerged in water in such a manner that the bottom of the water flow pipe is spaced apart from the lower wall, wherein the water flow pipe comprises:

a first pipe having a first inner diameter and being joined to the inlet;

a second pipe having a second inner diameter smaller than the first inner diameter and extending downwardly from the bottom of the first pipe; and a water channel formed in a body of the second pipe defining the second inner diameter in such a way as to fluidably communicate with the inside of the second pipe, wherein the second pipe and the water channel are located under the surface of the water, and the dust contained in the air introduced into the second pipe through the first pipe is collected by the water supplied through the water channel.

2. The dust collection unit according to claim 1, wherein a plurality of the water channels are inclined downwardly toward the center of the second inner diameter and provided along the circumference of the second pipe.

3. A vacuum cleaner comprising:

a suction part for inhaling dust and air;

a fan-motor unit providing a suction power to the suction part; and the dust collection unit according to claim 2, the dust collection unit being arranged in an air flow path between the suction part and the fan-motor unit for collecting the dust.

4. The dust collection unit according to claim 1, wherein the water flow pipe extends downwardly from the bottom of the second pipe and further comprises a third pipe whose inner diameter becomes gradually larger than the second inner diameter in the downward direction.

5. A vacuum cleaner comprising:

a suction part for inhaling dust and air;

a fan-motor unit providing a suction power to the suction part; and the dust collection unit according to claim 4, the dust collection unit being arranged in an air flow path between the suction part and the fan-motor unit for collecting the dust.

6. The dust collection unit according to claim 1, further comprising:

a filter arranged between the surface of the water and the lower wall, the bottom of the water flow pipe being inserted into the filter.

7. The dust collection unit according to claim 6, further comprising:

a water cyclone member arranged between the surface of the water and the filter for rotating the water containing dust and air in the circumferential direction.

8. The dust collection unit according to claim 7, wherein the water cyclone member comprises:

a vertical wall formed in a ring shape and arranged under the surface of the water in such a way as to be in contact with the inner wall of the container;

a plurality of discharge parts protruding in the direction of the height of the vertical wall and respectively having discharge holes formed at one side thereof in the circumferential direction, the discharge parts being joined to the inner face of the vertical wall along the circumferential direction; and an inclined wall extending toward the center of the vertical wall from the discharge parts in such a way as to be inclined downwardly, the second pipe being inserted into the inclined wall, wherein the inlet of the water channel faces a space formed between the inclined wall and the surface of the water.

9. A vacuum cleaner comprising:

a suction part for inhaling dust and air;

a fan-motor unit providing a suction power to the suction part; and the dust collection unit according to claim 8, the dust collection unit being arranged in an air flow path between the suction part and the fan-motor unit for collecting the dust.

10. A vacuum cleaner comprising:

a suction part for inhaling dust and air;

a fan-motor unit providing a suction power to the suction part; and the dust collection unit according to claim 7, the dust collection unit being arranged in an air flow path between the suction part and the fan-motor unit for collecting the dust.

11. A vacuum cleaner comprising:

a suction part for inhaling dust and air;

a fan-motor unit providing a suction power to the suction part; and the dust collection unit according to claim 6, the dust collection unit being arranged in an air flow path between the suction part and the fan-motor unit for collecting the dust.

12. A vacuum cleaner comprising:

a suction part for inhaling dust and air;

a fan-motor unit providing a suction power to the suction part; and the dust collection unit according to claim 1, the dust collection unit being arranged in an air flow path between the suction part and the fan-motor unit for collecting the dust.

* * * * *